US008418325B2

(12) United States Patent
Lemosquet et al.

(10) Patent No.: US 8,418,325 B2
(45) Date of Patent: Apr. 16, 2013

(54) DEVICE AND METHOD FOR THE CONNECTION AND THE LOCKING OF TWO PARTS AND BALL BAR

(75) Inventors: Vincent Lemosquet, Bons-en-Chablais (FR); Jerome Tyrode, Gaillard (FR)

(73) Assignee: Rolex S.A., Geneva (CH)

( * ) Notice: Subject to any disclaimer, the term of this patent is extended or adjusted under 35 U.S.C. 154(b) by 583 days.

(21) Appl. No.: 12/726,069

(22) Filed: Mar. 17, 2010

(65) Prior Publication Data

US 2010/0242234 A1 Sep. 30, 2010

(30) Foreign Application Priority Data

Mar. 25, 2009 (EP) ..... 09405056

(51) Int. Cl.
*A44C 5/24* (2006.01)

(52) U.S. Cl.
USPC ..... 24/265 WS; 24/906

(58) Field of Classification Search ..... 24/265 WS, 24/265 B, 906; 403/166, 304, 368; 368/282
See application file for complete search history.

(56) References Cited

U.S. PATENT DOCUMENTS

| | | | | |
|---|---|---|---|---|
| 2,382,249 | A * | 8/1945 | Megar | 24/265 B |
| 4,194,265 | A | 3/1980 | Zimmermann | |
| 6,023,816 | A | 2/2000 | Okada et al. | |
| 6,073,316 | A | 6/2000 | Ferrario et al. | |
| 6,119,315 | A * | 9/2000 | Gay | 24/68 J |
| 6,197,030 | B1 * | 3/2001 | Pham | 24/265 B |
| 6,434,798 | B1 * | 8/2002 | Yamakawa et al. | 24/265 WS |
| 6,923,593 | B2 * | 8/2005 | Nussbaum | 24/265 B |
| 7,249,398 | B2 * | 7/2007 | Roy | 24/265 B |

FOREIGN PATENT DOCUMENTS

| | | | |
|---|---|---|---|
| CH | 207554 | A | 11/1939 |
| CH | 624836 | A5 | 8/1981 |
| EP | 0908112 | A1 | 4/1999 |
| FR | 2600869 | A1 | 1/1988 |
| FR | 2653980 | A1 | 5/1991 |
| WO | 96/31138 | A1 | 10/1996 |

OTHER PUBLICATIONS

European Search Report, mailing date of Aug. 7, 2009, issued in corresponding European Patent Application 09405056.4.

* cited by examiner

*Primary Examiner* — Robert J Sandy
(74) *Attorney, Agent, or Firm* — Westerman, Hattori, Daniels & Adrian, LLP

(57) ABSTRACT

A device for the connection and the locking of two parts (30*a*, 30*b*), including a female part (10) comprising two bars (12), a male part (21) cooperating with this female part (10), and a hinged flap (17). Each bar (12) contains two balls (2*a*, 2*b*) and at least one movable inner stop (5) arranged between the balls (2*a*, 2*b*). The axial length of the movable stop (5) plus the diameters of the two balls (2*a*, 2*b*) is greater than the distance between the two lateral faces of the branch (11*a*, 11*b*) in which the ball bar (12) is situated. Also provided is a method for the connection and the locking of two parts, a ball bar, and a method for producing the latter and to the uses thereof.

17 Claims, 8 Drawing Sheets

DEVICE AND METHOD FOR THE CONNECTION AND THE LOCKING OF TWO PARTS AND BALL BAR

The invention relates to a device and a method for the connection and the locking of two parts, such as the ends of a necklace, of a belt or the two bracelet strands of a watch.

The invention also relates to a ball bar comprising a movable inner stop, to a method for manufacturing this ball bar and to the uses of this ball bar, in particular in devices for the connection of parts.

BACKGROUND OF THE INVENTION

It has been known for quite some time to use retractable balls mounted on a spring.

In this regard, mention may be made, for example, of the device described in the French patent application published under the number FR 2 600 869. This device is intended in particular for the closing and the locking of a bracelet. It comprises (cf. FIG. 1 of FR 2 600 869) a U-shaped member 1 comprising, at each end of the branches 4 and 4' of the U, a lug 6 or 6' at the end of which is situated a ball 15 mounted on a spring, which ball is intended to snap-fasten into a receiving cavity 16 formed in a receiving member 2 cooperating with the U-shaped member 1, in order to form a connection between the members 1 and 2.

In this device, an upper pivoting flap 12 can be swiveled down to entrap the lugs 6 and 6' and thus lock the connection between the two members 1 and 2 (cf. FIG. 3 of FR 2 600 869). The upper pivoting flap 12, also called a safety lock, particularly has the function of blocking the lugs 6 and 6' in their housing and of thus opposing an accidental disengagement.

However, if the end 3 is pulled in a direction perpendicular to the plane in which the opposite end 3' is situated, that is to say upward, the safety lock 12 opens and no longer opposes the disengagement of the lugs 6 and 6'. Moreover, the force of the positioning springs is not sufficient to retain the two balls in their housing 10, 10'. Furthermore, the free end (not numbered) of the safety lock 12, which comes to be housed behind the articulation 8 (cf. FIGS. 5 to 7 of FR 2 600 869) is worn and/or buckled too quickly. The safety lock 12 then pivots too easily and can no longer fulfill its function of preventing an accidental disengagement of the lugs 6 and 6' from their respective receiving housings 10 and 10'.

Also known are clasps such as that described in International Application No. WO96/31138. The main disadvantages of such a clasp are the following:

- it is very difficult to assemble,
- it comprises a large number of parts, in particular four springs,
- the upper part of its locking stud wears with time,
- the inner walls of its safety cover end up by being marked with grooves due to the friction of the ends of the locking elements, and
- the safety cover must, in its first embodiment, allow a certain degree of elastic deformation to allow the clasp to close.

Moreover, Swiss Patent No. 624 836 describes a bracelet clasp comprising a ball tube comprising a ball at each end and a spring intended to exert an outwardly directed force on the balls.

On the other hand, the subject of Swiss Patent No. 207 554 is a device for attaching a watch bracelet link provided with a tube having, at each of its ends, a stop in contact with a helical spring.

SUMMARY OF THE INVENTION

The object of the invention is, in particular, to overcome the disadvantages of the aforementioned device and clasps. The invention relates, according to a first aspect, to a device for the connection and the locking of two parts, comprising:

- a U-shaped female part provided with a bar on each branch of the U;
- a male part comprising an end capable of being inserted into the opening of the female part and of cooperating with the two bars of this female part;
- a hinged flap capable of cooperating with each bar, this hinged flap being fastened on the female part or on the male part;

and being characterized in that each bar contains two balls, one at each of its ends, and also at least one movable inner stop arranged inside the ball bar, between these balls, the axial length of the movable stop plus the diameters of the two balls being greater than the distance between the two lateral faces of the branch in which the ball bar is situated.

This device has the distinguishing feature of not being able to open accidentally and of wearing very little over time.

The invention also relates to a method of connecting and of locking two parts by means of the device according to the invention, comprising the following steps:

- the hinged flap is opened;
- the end of the male part is introduced into the opening of the female part until a first snap-fastening is produced; and
- the hinged flap is swiveled in the direction of the bars until a second snap-fastening is produced.

According to a second aspect, the invention relates to a new type of ball bar that the inventors have developed during their research.

The ball bar according to the invention is distinguished from the known ball bars through the existence of at least one inner stop arranged inside the bar, between the balls, which can move along the longitudinal axis of the bar and of which the axial length is chosen such that when one of the balls is fully retracted into the hollow part of elongate shape, it is impossible for the other ball to retract fully into the ball bar.

Such a ball bar can be used in all sorts of fields.

It can advantageously serve to connect the two ends of a necklace, of a belt or the two strands of a bracelet, in particular a watch bracelet.

The invention also relates to a method for producing the ball bar according to the invention, this method comprising a step during which a movable inner stop is introduced inside the ball bar.

The methods of producing or mounting the device according to the invention have the advantage of being relatively simple owing to the small number of parts involved.

Other features and advantages of the invention will now be described in detail in the description which follows and which is given with reference to the appended figures, in which.

DETAILED DESCRIPTION OF THE INVENTION a) Device for the Connection and the Locking of Two Parts

Figure 1:
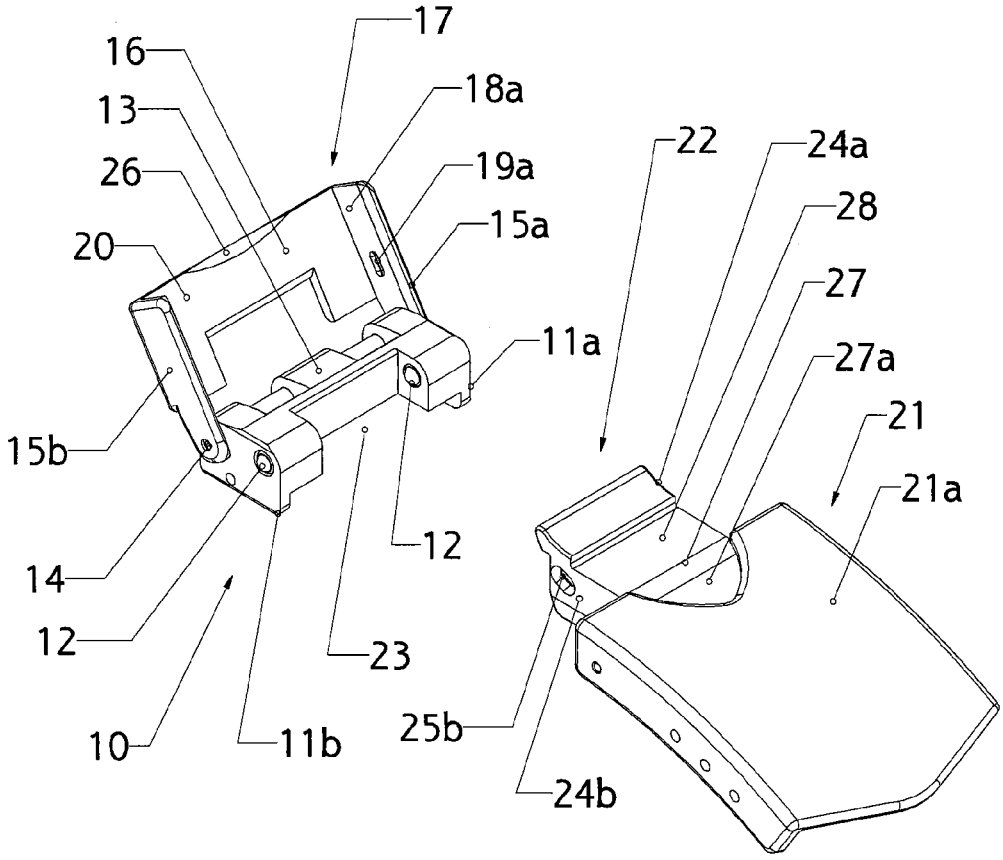
FIG. 1 shows a perspective view of a device according to the invention for the connection and the locking of two parts.

This device is represented in FIG. 1.

Female Part

The device according to the invention comprises a generally U-shaped female part 10 comprising a substantially parallelepipedal base 13 from which two substantially parallelepipedal branches 11*a*, 11*b* extend perpendicularly.

These branches 11*a*, 11*b* are traversed at the ends opposed to the base 13 by two ball bars 12 according to the invention, which are introduced, in general press-fitted, into these branches 11*a*, 11*b* and of which the longitudinal axes of symmetry are coincident and are substantially perpendicular to the axis of symmetry of the U and parallel to the plane of the U. Preferably, the length of the ball bars 12 is substantially equal to the distance between the two lateral faces of the branch 11*a*, 11*b*.

On the two lateral faces of the base 13 of the U which are parallel to the axis of symmetry of the U, there are provided holes for receiving pins 14 connected to the rear of two lateral tabs 15*a*, 15*b* fastened symmetrically on either side of a plate 16 of substantially rectangular shape. These lateral tabs 15*a*, 15*b* are flat and perpendicular to the plate 16 from which they extend adjacent to the branches 11*a*, 11*b* of the U. Thus, the plate 16 forms, together with the lateral tabs 15*a*, 15*b*, a hinged flap 17 articulated about the pins 14. The dimensions of the plate 16 are normally designed to allow it cover at least the most part of the U.

In FIG. 1, the hinged flap 17 is in a completely open position, that is to say that its plate 16 forms an angle slightly greater than 90 degrees with the plane of the U formed by the part 10.

The respective inner faces 18*a*, 18*b* of the lateral tabs 15*a*, 15*b* each comprise, at the front, a notch 19*a*, 19*b* of which the location and the size make it capable of cooperating with a ball of a bar 12.

Male Part

The female part 10 of the device according to the invention which has just been described is intended to cooperate with a male part 21 represented to the right in FIG. 1.

This male part 21 comprises a main body 21*a* of any shape and an extension or end 22 capable of being inserted into the opening 23 of the female part 10.

This end 22 is generally of parallelepipedal shape and comprises on two lateral faces 24*a*, 24*b* two notches 25*a*, 25*b* which are able and intended, in a similar manner to the notches 19*a*, 19*b* of the hinged flap 17, to receive a portion of the inner balls 2*b* of the ball bars 12. Preferably, the notches 25*a*, 25*b* are deeper than the notches 19*a*, 19*b*.

Advantageously, the hinged flap 17 is intended to cover, other than the most part of the U formed by the female part 10, the upper face 28 of the end 22 so as to hide this end 22 once the female 10 and male 21 parts have been connected.

According to an advantageous embodiment, the hinged flap 17 of the female part 10 comprises a lug 26 at the front, that is to say on a side of the plate 16 opposed to the pins 14, and the main body 21*a* of the male part 21 comprises a recess 27 capable of receiving this lug 26 while forming a space 27*a* which is better visible in FIG. 13 and which will be discussed in relation to that figure.

b) Ball Bar According to the Invention

Figure 2:
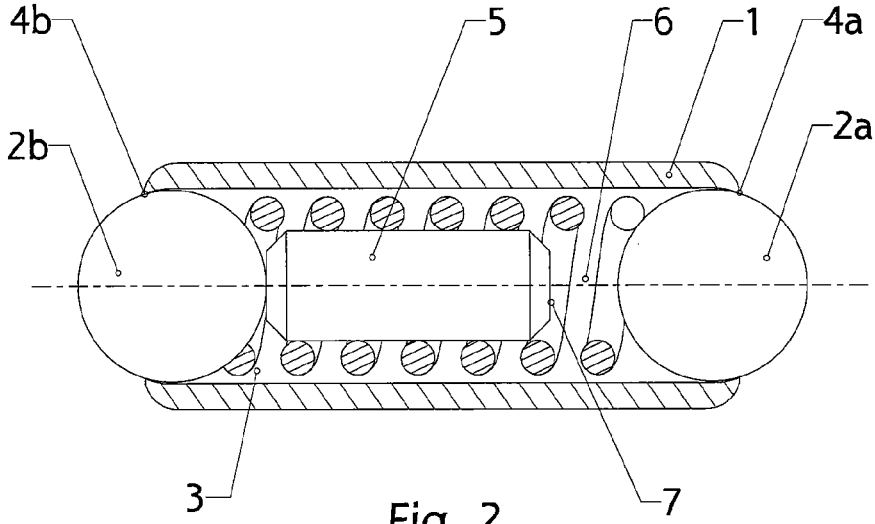
FIG. 2 shows a front view in section of a bar according to the invention.
Figure 3:
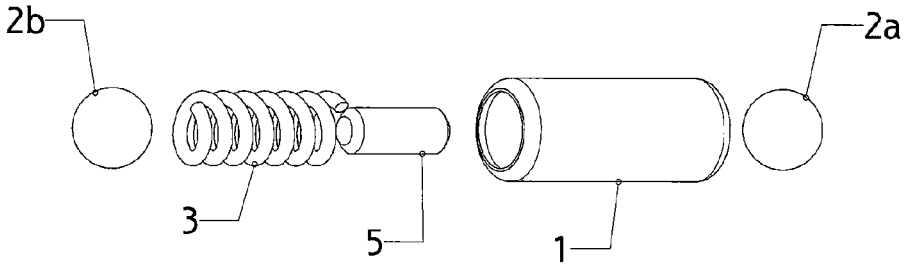
FIG. 3 shows an exploded perspective view of the ball bar in FIG. 2.

FIGS. 2 and 3 represent a ball bar 12 according to the invention.

This bar 12 comprises a hollow part 1 of elongate shape—in general a hollow cylinder—inside which are arranged two balls 2*a*, 2*b* and, preferably, an elastic means 3.

The balls 2*a*, 2*b* have a diameter which is slightly less than the inside diameter of the cylinder, so as to be able to move inside this cylinder. To prevent them from coming out of it, the longitudinal ends 4*a*, 4*b* of the cylinder have been drawn in toward the inside so as to reduce their inside diameter.

The elastic means 3 which can be situated between the balls 2*a*, 2*b*, and which may be a helical spring, serves to separate these balls and to push them toward the ends 4*a*, 4*b*. The balls 2*a*, 2*b* are thus constantly pushed by the spring 3 toward the outside of the cylinder 1 but retained inside the latter by its ends 4*a*, 4*b*.

By pressing on the ball 2*a* and/or the ball 2*b* while opposing the force of the spring 3, it is possible to retract it or them more or less completely inside the cylinder 1.

What is particular to the ball bar 12 according to the invention is that it comprises at least one movable inner stop 5 arranged inside the hollow part of elongate or cylindrical shape 1, between the balls 2*a*, 2*b*.

This movable inner stop 5 preferably has the form of a pin with a circular cross section and with optionally chamfered ends. It is movable, that is to say it can move inside the bar along the longitudinal axis of the hollow part 1. Its travel is limited by the balls 2*a*, 2*b*.

The movable stop 5 generally consists of a hard material such as stainless steel, for example of the 316L or 904L type.

Since the optional spring 3 is generally helical, said stop is preferably arranged inside this spring when it is present.

The axial length of the movable inner stop 5, that is to say its dimension along the longitudinal axis of the cylinder 1, is substantially less than the distance separating the balls 2*a*, 2*b* along the longitudinal axis of the cylinder 1 when these balls are respectively in contact with the ends 4*a* and 4*b* of the cylinder 1. When the spring 3 exists, the balls are separated from one another by this spring. Thus, as can be seen in FIG. 2, there is a space 6 between a transverse side 7 of the movable inner stop 5 and the ball 2*a*.

It goes without saying that the movable inner stop 5 could not be in contact with the ball 2*b* and not be in contact with the ball 2*a* either. In this case (not shown), instead of the space 6 there will be a first space between the movable inner stop 5 and the ball 2*a* and a second space between the movable inner stop 5 and the ball 2*b*.

FIG. 3 represents an exploded view of the bar in FIG. 2.

The advantage afforded by this ball bar 12 over a ball bar of the prior art which does not have a movable stop is that the presence of the movable inner stop 5 makes it possible to limit the degree to which the balls 2*a*, 2*b* can approach one another. In other words, if each of the balls 2*a*, 2*b* is pushed toward the inside of the cylinder 1, they each end up by coming into contact with a transverse side of the movable inner stop 5. From that moment, they can no longer retract more into the cylinder 1 since they are prevented from doing so by the presence of the movable inner stop 5 between them.

It follows that by choosing a suitable axial length for the movable inner stop 5, it can be provided that if one of the balls 2*a* or 2*b* is completely pushed inside the branch 11*a* or 11*b* of the female part 10, the other (2*b* or 2*a*) can no longer be retracted inside this same branch 11*a* or 11*b*, since the movable inner stop 5 blocks its entry and therefore makes impossible any movement of this other ball 2*b* or 2*a* along the longitudinal axis of the cylinder 1. Therefore, the axial length of the movable stop 5 plus the diameters of the two balls 2*a*, 2*b* is greater than the distance between the two lateral faces of the branch 11*a*, 11*b* in which the ball bars 12 are press-fitted.

Figure 4:
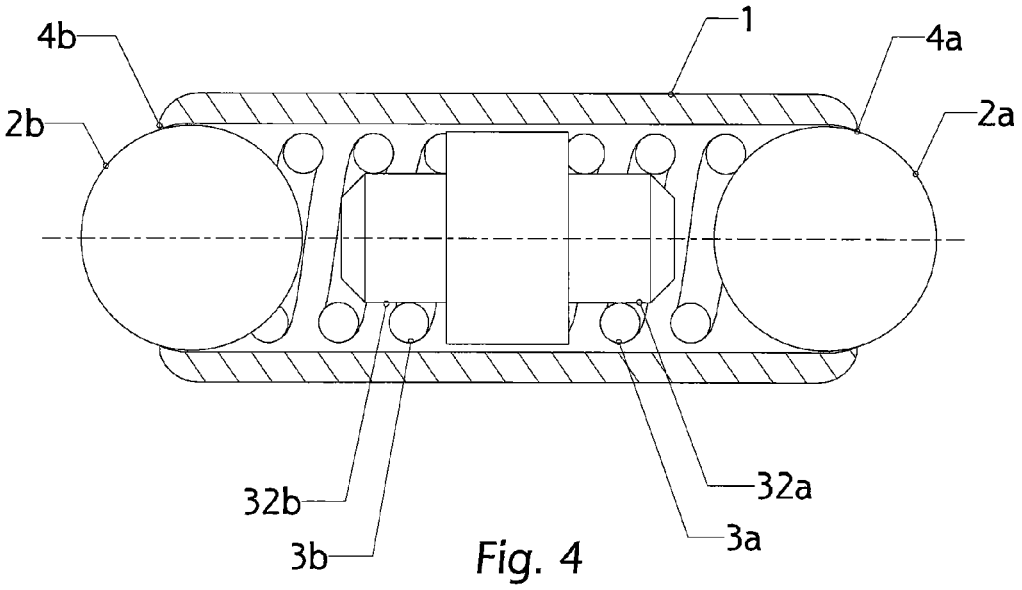
FIGS. 4 to 7 show variants of the ball bar according to the invention.

FIG. 4 represents a variant of the ball bar according to the invention comprising two springs 3*a* and 3*b* situated on one longitudinal side and on the other of a movable stop comprising two respective centering tenons 32*a*, 32*b* for the springs 3*a* and 3*b*.

Figure 5:
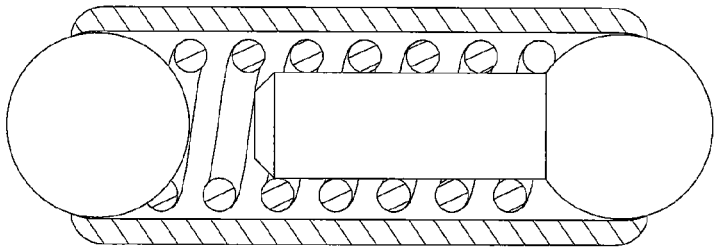

FIG. 5 represents another variant of the ball bar according to the invention in which the movable stop has been secured to one of the balls.

Figure 6:
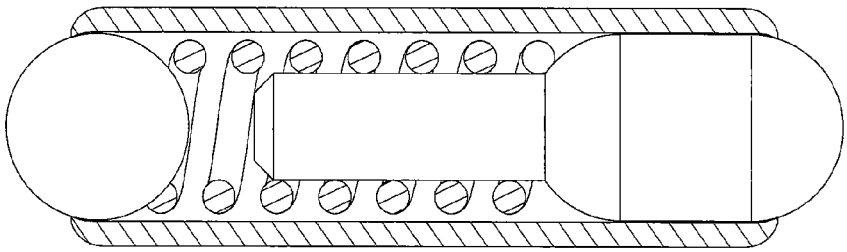

FIG. 6 represents another variant of the ball bar according to the invention in which the movable stop is secured to one of the balls, as in FIG. 5, and the ball secured to the stop has been elongated along the longitudinal axis of the hollow part and thus has a substantially cylindrical shape.

Figure 7:
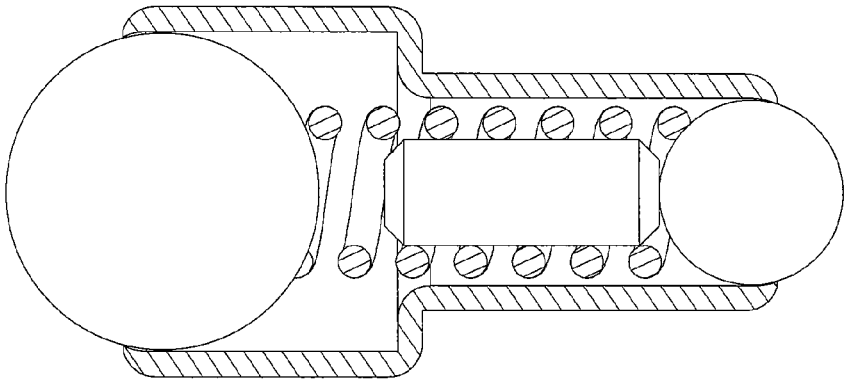

FIG. 7 represents yet another variant of the ball bar according to the invention, in which the elongate hollow part is formed by two portions of different diameters and, therefore, the corresponding balls in turn also have different diameters.

c) Method of Connecting and Locking Two Parts

Returning now to FIG. 1, it will be understood that when the hinge flap 17 is pivoted toward the front about the pins 14 to move it into a closed position, the inner face 20 of its plate 16 comes into contact with the part 10, and the outer balls 2*a* of the bar 12, which are situated on the outer faces of the branches 11*a*, 11*b* of the U, that is to say those opposed to the opening 23 formed by this U, are partially introduced into the notches 19*a*, 19*b* of the lateral tabs 15*a*, 15*b*, thus causing the hinged flap 17 to snap-fasten into the branches 11*a*, 11*b* of the female part 10. The hinge flap 17 thus remains in this closed position by virtue of the thrust exerted by the spring 3 on the outer balls 2*a* of the ball bar 12.

Figure 8:
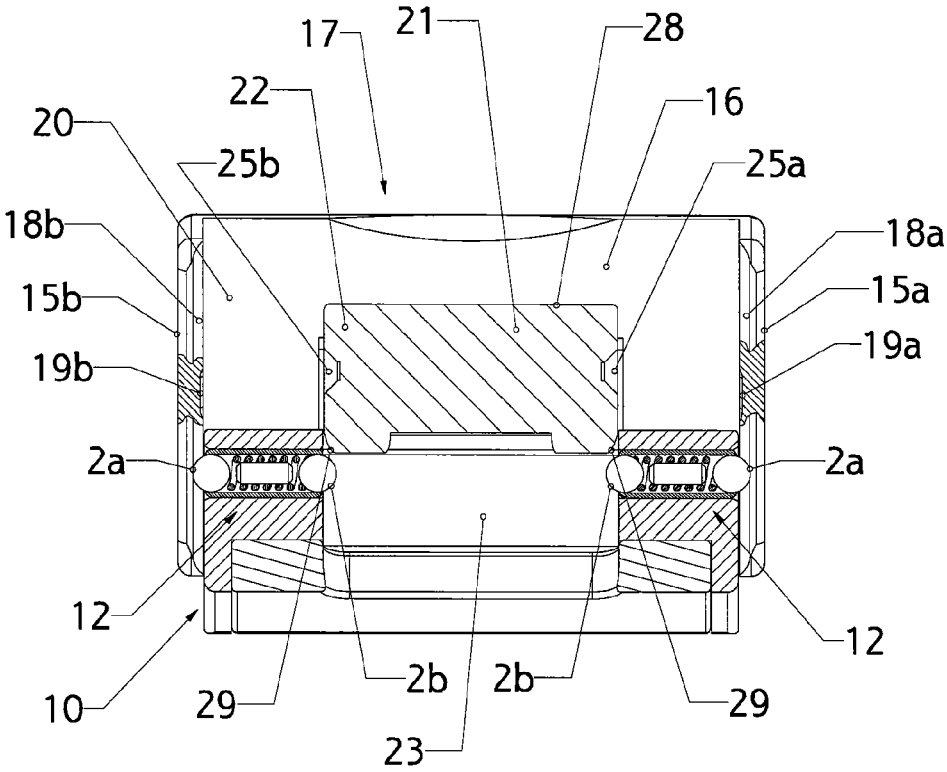
FIG. 8 shows a view from the right in section of the device in FIG. 1, before the connection.
Figure 9:
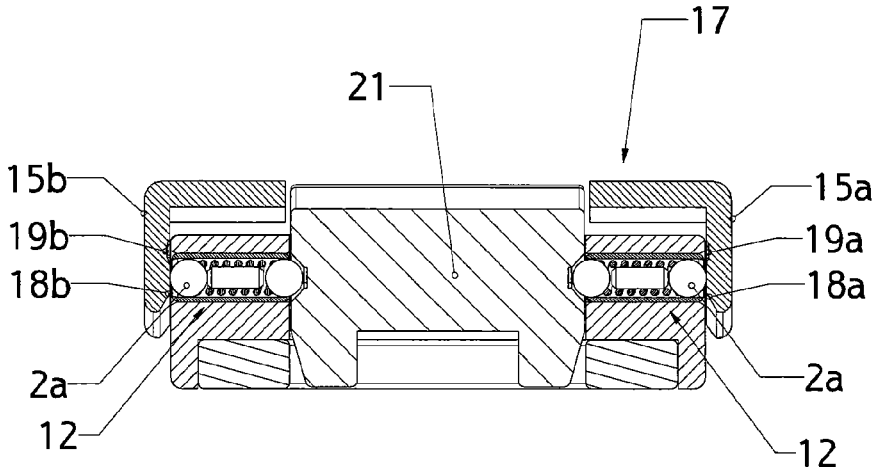
FIG. 9 shows a view from the right in section of the device in FIGS. 1 and 8, after the connection and before the locking.
Figure 10:
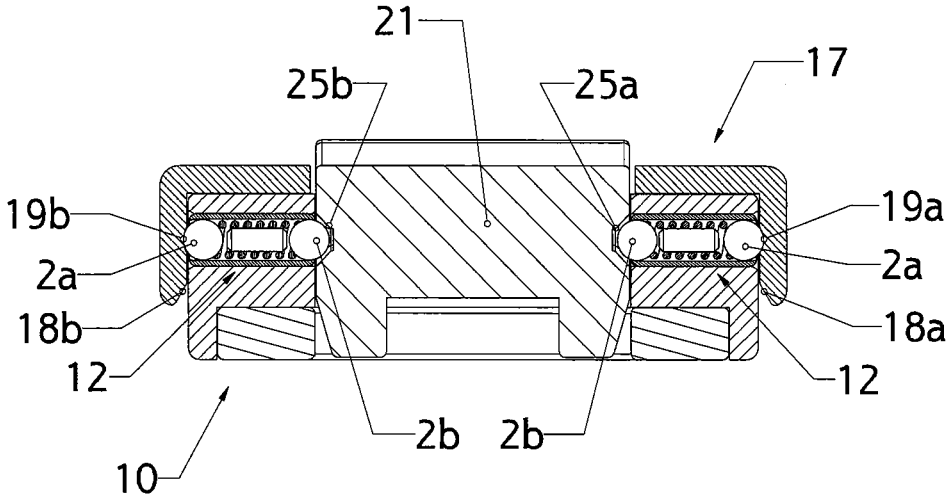
FIG. 10 shows a view from the right in section of the device in FIGS. 1, 8 and 9, after the connection and after the locking.

To better understand the operation of the device according to the invention, reference may now be made to FIGS. 8 to 10.

In FIG. 8, the hinged flap 17 is in an open position and the male part 21 is moved close to the female part 10. The end 22 of the part 21 is moved from top to bottom, that is to say toward the opening 23 of the female part 10. The connection has not yet taken place.

To arrive at the situation in FIG. 9, the end 22 is introduced into the opening 23. This introduction is facilitated by the chamfers 29 provided on the bottom portion of the end 22.

Then, the end 22 is lowered until the inner balls 2*b* of the bars 12 are introduced into the notches 25*a*, 25*b*, thus causing the male part 21 to snap-fasten into the female part 10. The connection between the female 10 and male 21 parts is then achieved.

To then arrive at the situation represented in FIG. 10, the hinge flap 17 is swiveled downward. The outer balls 2*a* of the two bars 12 then roll or slide on the inner faces 18*a*, 18*b* of the lateral tabs 15*a*, 15*b* until they arrive in the notches 19*a*, 19*b*, thus causing the hinge flap 17 to snap-fasten into the female part 10. The locking of the female 10 and male 21 parts is then complete.

If the hinged flap 17 then continues to be pushed downward, the inner face 20 of this flap then comes into contact with the upper face of the female part 10, thereby preventing any continuation of the downward movement.

In the closed position, the hinged flap 17 has moved the outer ball 2*a* against the movable stop 5; the latter has moved closer to the inner ball 2*b*, which can no longer move sufficiently to release the male part 21. The male 21 and female 10 parts are thus locked.

The hinged flap 17 thus performs a safety function. During its lowering the outer balls 2*a* are completely retracted into their respective bar 12 and then reemerge partly to occupy their notch 19*a*, 19*b* on the respective inner face 18*a*, 18*b* of a lateral tab 15*a*, 15*b* of the hinged flap 17.

If provision is made for the depth of the notches 19*a*, 19*b* of the hinged flap 17 to be less than the depth of the notches 25*a*, 25*b* of the end 22, once the locking has been carried out the inner balls 2*b* are more stressed than in the non-snap-fastened state and, therefore, the male 21 and female 10 parts are completely locked. This has the advantage of making it possible to provide both easy snap-fastening and good locking since when the locking is carried out, that is to say when the hinge flap 17 is swiveled down, the stop 5 prevents the return of the inner ball 2*b* and the union between the male 21 and female 10 parts is thus reinforced.

The device according to the invention therefore has a considerable advantage over the devices of the prior art: during an impact, the hinged flap 17 has a tendency to open. It then pushes the outer balls 2*a* toward the inside of the bars 12, which has two effects:

- on the one hand, this increases the thrust of the spring 3 on the inner balls 2*b* and then makes it more difficult to separate the female 10 and male 21 parts, and
- on the other hand, if the axial length of the movable inner stop has a suitable length, the outer balls 2*a* pushed by the inner faces 18*a*, 18*b* themselves push the movable inner stops 5 which them come into contact with the inner balls 2*b*; it follows that the latter can no longer retract into their respective hollow part 1 and remain in the notches 25*a*, 25*b* of the end 22; therefore, the male 21 and female 10 parts cannot separate from one another, they are locked.

Thus, for example, if two bars according to the invention are used in a folding-buckle clasp, as will be explained in more detail below, these bars impose an operating order of the successive snap-fastenings and allow the connection (closure) between the male 21 and female 10 parts to be immobilized when the locking snap-fastening is being carried out.

Therefore, by virtue of the ball bar 12 according to the invention, it is possible to manufacture clasps which are reliable to 100%, that is to say which do not open in the event of impact.

An advantageous variant consists in providing an oblong shape for the notches 19*a*, 19*b*, 25*a*, 25*b* in the hinged flap 17 and in the male part 21, so as to allow an increase in the dimensional tolerances and therefore to facilitate the manufacture of the parts.

d) Uses of the Device According to Invention

The device according to the invention can be used for the connection and the locking of all sorts of mechanical parts.

The male 21 and female 10 parts can respectively form part of the parts to be assembled or else be connected thereto in a known manner.

In particular, the female 10 and male 21 parts can be connected to the two ends of a necklace, or of a belt or to the strands of a bracelet, in particular a watch bracelet.

Figure 11:
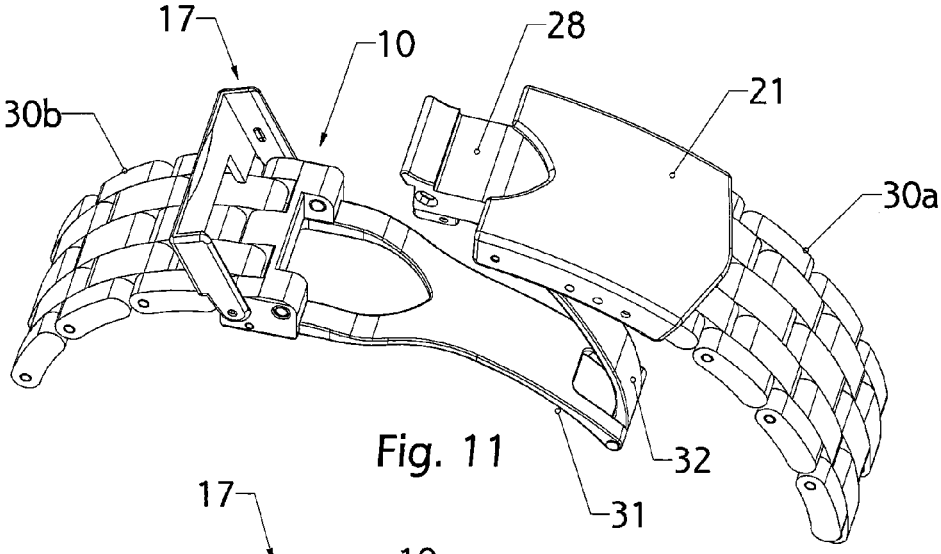
FIG. 11 shows a watch bracelet using the device according to the invention as a clasp, before its closure.
Figure 12:
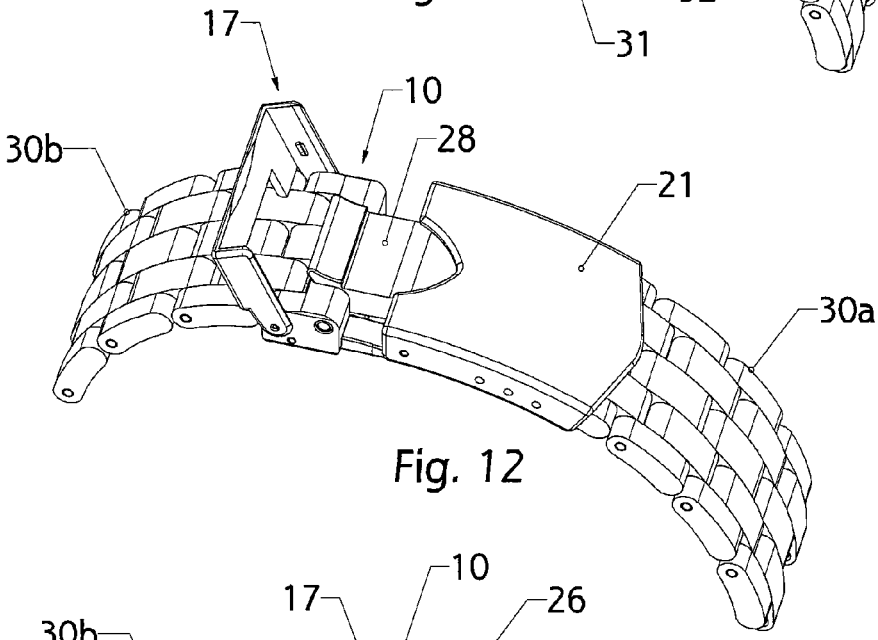
FIG. 12 shows the watch bracelet in FIG. 11, after closure and before locking.
Figure 13:
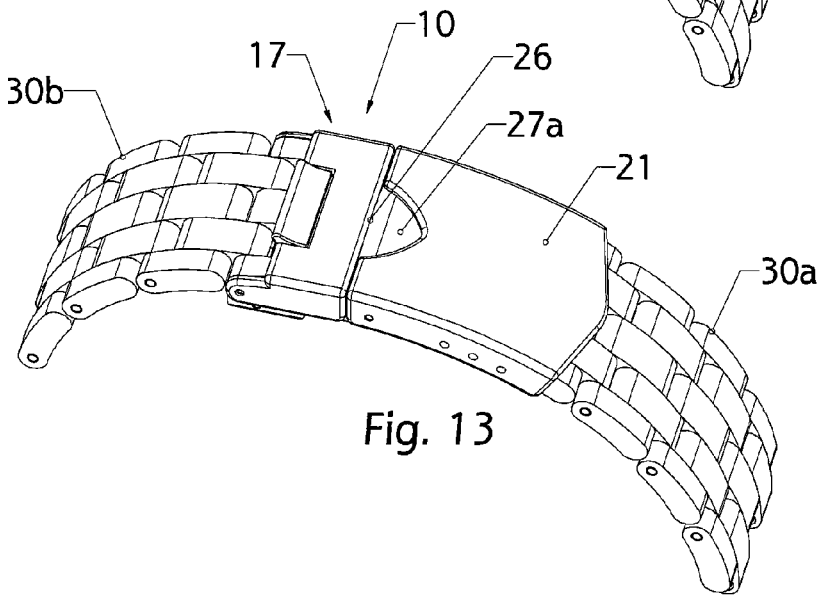
FIG. 13 shows the watch bracelet in FIGS. 11 and 12, after closure and locking.
Figure 14:
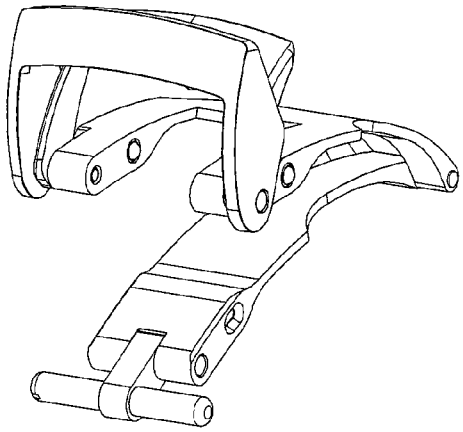
FIGS. 14 to 16 show the use of the device according to the invention as a clasp for a leather watch bracelet, respectively before the closure, after the closure and after the locking.
Figure 15:
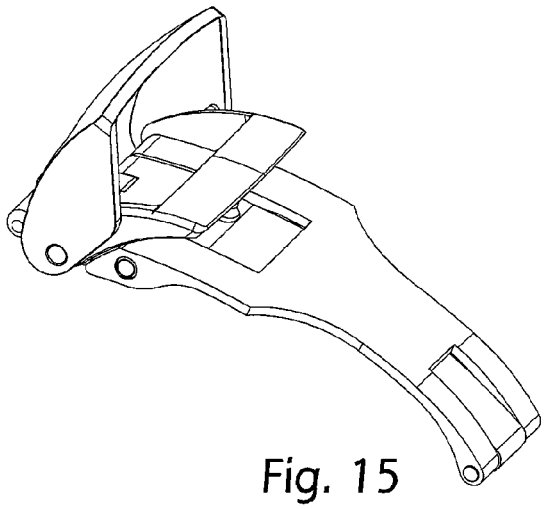
Figure 16:
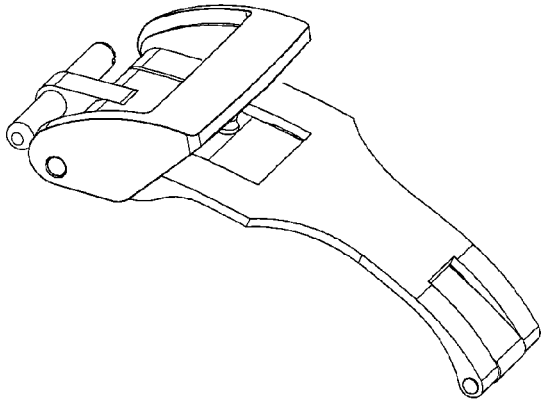
Figure 17:
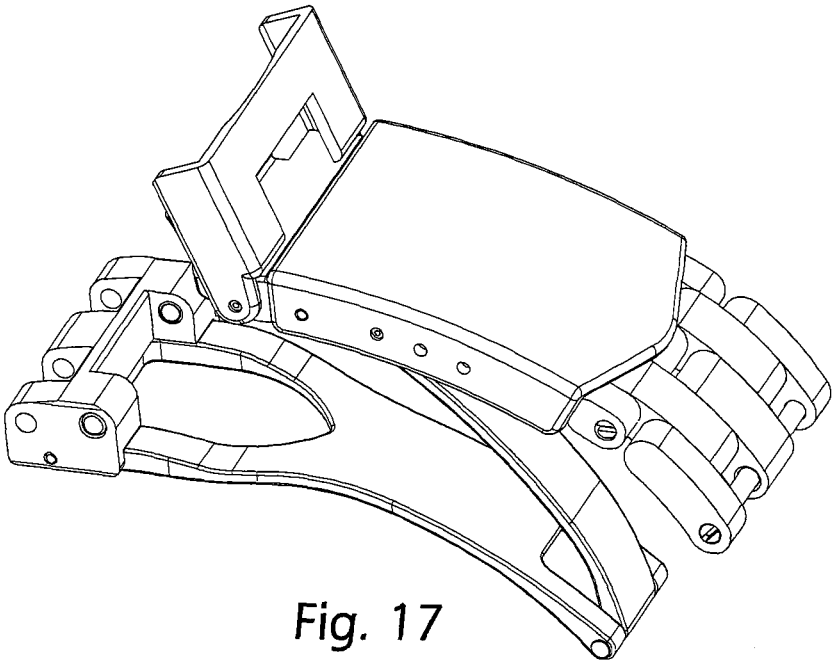
FIGS. 17 and 18 show the use of the device according to the invention as a clasp for a bracelet having a known rapid extension system.
Figure 18:
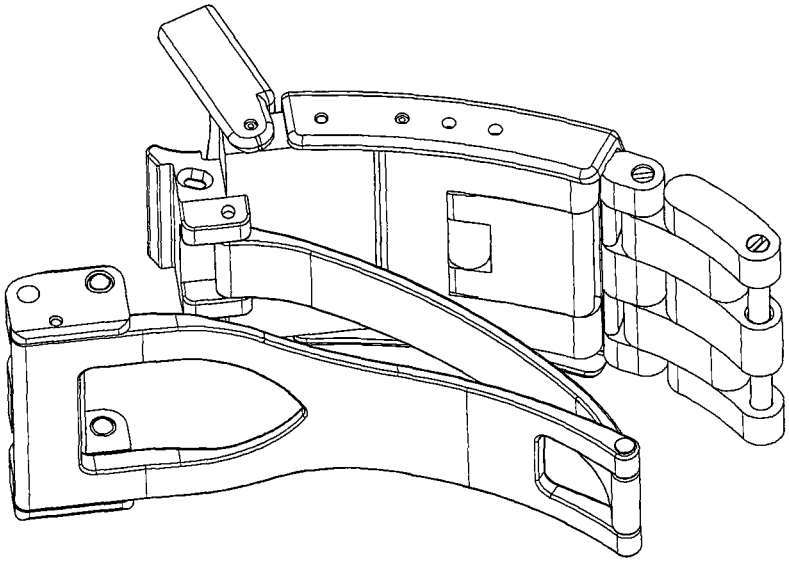

FIGS. 11 to 13 are an illustration of the use of the device according to the invention in a bracelet.

The male 21 and female 10 parts here constitute a bracelet clasp. They are respectively connected in a known manner to bracelet strands 30*a*, 30*b*. Furthermore, they are also connected to one another in a known manner by a folding buckle having two leaves 31, 32.

In FIG. 11, the bracelet is open, that is to say that the male 21 and female 10 parts are neither snap-fastened nor locked.

By moving the male part 21 toward the female part 10, snap-fastening or closure is carried out, so as to arrive at the closed state which is represented in FIG. 12.

Then, by swiveling the hinged flap 17 toward the female part 10, locking is carried out, so as to arrive at the locked state which is represented in FIG. 13.

In this use, once snap-fastening and locking have been carried out, the male part 21 cannot be pushed downward by virtue of the obstacle constituted by the folding buckle. In addition, as has been explained above, it cannot, in the event of impact, move upwardly by virtue of the hinged flap and the movable inner stop 5. The male part 21 is therefore completely locked owing to the presence of the movable inner stops 5.

It emerges from all this that it is virtually impossible for the clasp to open during an impact such as banging the wrist on a table.

In FIG. 13, it can be seen that the space 27*a* remains free once the hinged flap 17 has been lowered. This space 27*a* allows the user to easily raise the plate 16 using a nail and thus facilitates the unlocking of the clasp.

e) Method of Manufacturing Ball Bars According to the Invention

The ball bars 12 according to the invention can be manufactured according to methods having, in addition to the conventional manufacturing steps common with those of the manufacture of a conventional ball bar, a step during which the movable inner stop 5 is introduced into the hollow part of elongate shape 1.

In order to manufacture a ball bar 12 according to the invention, it is possible, for example, to proceed as follows:

- a hollow part 1 of elongate shape, two balls 2*a*, 2*b*, a spring 3 and a movable inner stop 5 are obtained;
- a first longitudinal end 4*a* of the hollow part 1 is drawn in;
- a first ball 2*a* is introduced into the hollow part 1 through the end 4*b* thereof; then
- the spring 3 is introduced through the end 4*b* into the hollow part 1;
- the movable inner stop 5 is introduced through the end 4*b* into the hollow part 1, inside the spring 3;
- the second ball 2*b* is introduced into the hollow part 1; and, finally,
- the second longitudinal end 4*b* of the hollow part 1 is drawn in.

It is possible to draw in the ends 4*a* and 4*b* by compression or crimping using a crimping device or by any other suitable method.

The ball bar according to the invention can be used in many devices.

It can be used, in particular, for the connection and/or the locking of any parts.

In the figures, the hinged flap has always been represented as being fastened on the female part of the device according to the invention. However, it can also be fastened on the male part.

The invention claimed is:

1. A device for the connection and the locking of two parts, comprising:

- a U-shaped female part provided with a bar on each branch of the U-shaped female part;
- a male part comprising an end capable of being inserted into an opening of the female part and of cooperating with the two bars of the female part;
- a hinged flap capable of cooperating with each bar; the hinged flap being mounted on the female part or the male part;

wherein each bar contains

- two balls each arranged at a respective end thereof;
- at least one movable inner stop arranged between the balls;
- the axial length of the movable stop plus the diameters of the two balls being greater than the distance between two lateral faces of the branches in which the bar is situated.

2. The device as claimed in claim 1, in which each bar comprises at least one elastic means separating the balls from one another.

3. The device as claimed in claim 2, in which the elastic means is a helical spring and the movable inner stop is arranged inside this helical spring.

4. The device as claimed in claim 1, in which the hinged flap comprises a plate provided on its lateral sides with tabs which are flat, perpendicular to the plate and which are each provided, on their face directed toward the other tab, with a notch capable of receiving a ball of one of the bars.

5. The device as claimed in claim 4, in which the axial length of the movable inner stop of each bar is chosen such that each of the balls can retract fully into the ball bars but such that it is impossible for the two balls to retract at the same time fully into the bar.

6. The device as claimed in claim 1, in which the hinged flap is fastened on the female part.

7. The device as claimed in claim 1, in which the female and male parts are connected respectively to the two ends of a necklace, of a belt or to two strands of a bracelet.

8. A method of connecting and of locking two parts by means of a device as claimed in claim 1, comprising the following steps:

- the hinged flap is opened;
- the end of the male part is introduced into the opening of the female part until a first snap-fastening is produced; and
- the hinged flap is swiveled in the direction of the bars until a second snap-fastening is produced.

9. A ball bar comprising:

- a hollow part of elongate shape, the longitudinal ends of said elongate shape being drawn in;
- two balls arranged inside the hollow part of elongate shape, at each of its longitudinal ends; and
- at least one movable inner stop arranged inside the hollow part of elongate shape, between the balls, wherein the axial length of the movable inner stop is chosen such that when one of the balls is fully retracted into the hollow part of elongate shape, it is impossible for the other ball to retract fully into the ball bar.

10. The ball bar as claimed in claim 9, of which the hollow part of elongate shape is a hollow cylinder.

11. The ball bar as claimed in claim 9, additionally comprising an elastic means.

12. The ball bar as claimed in claim 11, in which the elastic means is a helical spring.

13. The ball bar as claimed in claim 12, in which the movable inner stop is arranged inside the helical spring.

14. The ball bar as claimed in claim 9, of which the movable inner stop takes the form of a pin.

15. A method of producing a ball bar as claimed in claim 9, comprising a step during which a movable inner stop is introduced into the hollow part of elongate shape.

16. A device comprising at least one ball bar as claimed in claim 9.

17. The use of a ball bar as claimed in claim 9 for the connection and/or the locking of parts.

* * * * *